US011998074B2

(12) United States Patent
Klabunde

(10) Patent No.: US 11,998,074 B2
(45) Date of Patent: Jun. 4, 2024

(54) MULTI-LAYER SWIMWEAR FITMENT APPARATUS

(71) Applicant: Karena Klabunde, Raleigh, NC (US)

(72) Inventor: Karena Klabunde, Raleigh, NC (US)

( * ) Notice: Subject to any disclaimer, the term of this patent is extended or adjusted under 35 U.S.C. 154(b) by 0 days.

(21) Appl. No.: 18/042,186

(22) PCT Filed: Sep. 7, 2022

(86) PCT No.: PCT/US2022/076031
§ 371 (c)(1),
(2) Date: Feb. 17, 2023

(87) PCT Pub. No.: WO2023/039412
PCT Pub. Date: Mar. 16, 2023

(65) Prior Publication Data

US 2023/0225427 A1 Jul. 20, 2023

Related U.S. Application Data

(60) Provisional application No. 63/261,086, filed on Sep. 10, 2021.

(51) Int. Cl.
*A41D 7/00* (2006.01)

(52) U.S. Cl.
CPC ..... *A41D 7/00* (2013.01); *A41D 2300/22* (2013.01); *A41D 2300/33* (2013.01); *A41D 2400/38* (2013.01); *A41D 2600/10* (2013.01)

(58) Field of Classification Search
CPC . A41D 1/22; A41D 7/00; A41D 7/005; A41D 13/0017; A41D 13/129;
(Continued)

(56) References Cited

U.S. PATENT DOCUMENTS 280,444 A * 7/1883 Bush ..... A41F 9/02 2/237
362,565 A * 5/1887 Yarwood ..... A61F 13/496 2/400

(Continued)

FOREIGN PATENT DOCUMENTS

CN 212279950 U 1/2021
JP 2004308089 A 11/2004

(Continued)

OTHER PUBLICATIONS

International Search Report and Written Opinion of the International Searching Authority in related International Application No. PCT/US2022/076031, dated Nov. 24, 2022, 12 pages.

*Primary Examiner* — Heather Mangine
*Assistant Examiner* — Matthew R Marchewka
(74) *Attorney, Agent, or Firm* — Thompson Patent Law Offices PC

(57) ABSTRACT

Apparatus and associated methods relate to a garment having adjustable closure modules to reduce unwanted exposure. In an illustrative example, a continuous one-piece swimsuit may include at least one distributed tension closure system (DTCS) at each side of the swimsuit. The DTCS, for example, may include an elastic layer disposed underneath a longitudinally adjustable tension member coupled to opposing lateral edges of the DTCS. For example, when the swimsuit is donned by a wearer and lengths of the adjustable tension members are individually adjusted to a corresponding desired tension, each adjustable tension members urges the opposing lateral edges together by the corresponding desired tension such that an aperture of the hip openings is adjusted to reduce unwanted exposure of a body of the wearer. Various embodiments may advantageously provide
(Continued)

modest fittings while maintaining a substantially smooth layer fitting comfortably to the wearer.

26 Claims, 4 Drawing Sheets

(58) Field of Classification Search
CPC .. A41D 15/00; A41D 19/0048; A41D 27/285; A41D 2300/33; A41D 2300/332; A41D 2400/38; A41D 2400/44; A41D 2400/82; A41D 2600/10; A41C 1/00; A41C 1/003; A41C 1/02; A41C 1/06; A41C 1/08; A41C 1/10
USPC ..... 2/67, 237, 69, 221; 450/136
See application file for complete search history.

(56) References Cited

U.S. PATENT DOCUMENTS 464,826 A * 12/1891 Kuhn ..... A41F 9/02 2/237
557,460 A * 3/1896 Weingarten ..... A41C 1/00 450/142
561,464 A * 6/1896 Woodruff ..... A41C 1/06 450/17
1,707,020 A * 3/1929 Kops ..... A41C 1/06 450/4
2,155,485 A * 4/1939 Graves ..... A41C 1/00 450/123
2,329,093 A * 9/1943 Sommers ..... A41D 7/001 D2/731
2,496,529 A * 2/1950 Golde ..... A41C 1/06 450/142
2,586,658 A * 2/1952 Hormann ..... A61F 5/03 450/143
2,587,450 A * 2/1952 Ericsson ..... A41C 1/10 450/143
3,191,601 A * 6/1965 Wanish ..... A41C 1/06 450/12
5,002,270 A * 3/1991 Shine ..... A63B 21/065 2/102
6,282,717 B1 * 9/2001 Ng ..... A41D 15/00 2/70
2005/0034205 A1 * 2/2005 Green ..... A63B 21/0004 2/69
2006/0010570 A1 * 1/2006 Villegas ..... A41D 1/14 2/211
2008/0256676 A1 10/2008 Lorenzo
2011/0197330 A1 * 8/2011 Simpson ..... A41D 7/00 2/243.1
2014/0250561 A1 9/2014 DiLorenzo
2016/0278438 A1 * 9/2016 Polidan ..... A41B 9/02
2017/0027235 A1 * 2/2017 Inzer ..... A41D 13/0015
2017/0027246 A1 * 2/2017 Inzer ..... A41D 31/18
2017/0027252 A1 * 2/2017 Inzer ..... A41B 9/001
2017/0265531 A1 9/2017 Toussaint et al.
2017/0273365 A1 * 9/2017 Muhlenfeld ..... A41B 1/08
2017/0325519 A1 11/2017 Willingham
2020/0093199 A1 3/2020 Fahey
2020/0229516 A1 * 7/2020 Curran ..... A41D 1/06
2021/0153573 A1 * 5/2021 Shams ..... A41D 7/00

FOREIGN PATENT DOCUMENTS

JP 3803703 B2 8/2006
JP 2016123783 A 7/2016
KR 20020006397 A 1/2002
KR 20030086494 A 11/2003
KR 20180001160 U 4/2018
WO 2017177023 A1 10/2017

* cited by examiner

MULTI-LAYER SWIMWEAR FITMENT APPARATUS

CROSS-REFERENCE TO RELATED APPLICATIONS

This application is a National Stage application of PCT Application Serial No. PCT/US22/76031, titled "Multi-layer Swimwear Fitment Apparatus," filed by Karena Klabunded on Sep. 7, 2022, which application claims the benefit of U.S. Provisional Application Ser. No. 63/261,086, titled "Multi-layer Swimwear Fitment Apparatus," filed by Karena Klabunde on Sep. 10, 2021.

This application incorporates the entire contents of the foregoing application(s) herein by reference.

TECHNICAL FIELD

Various embodiments relate generally to textile and garments.

BACKGROUND

Clothing is part of daily lives of any human society. Normally, clothing is made of cloth or fabric that is woven from a filament (e.g., yarn, thread). In modern days, clothing may be made with non-woven materials. There are different ways of creating clothes out of cloth. For example, one approach is simply draping the cloth and wrapping the cloth around a body. Some notable examples of this may be the dhoti for men and the sari for women in the Indian subcontinent, the Scottish kilt, and the Japanese sarong. This kind of clothing may simply be tied up or fixated with pins or belts to hold the garments in place (kilt and sarong). Since the cloth is not cut and sewn, people of various sizes can wear the same garment. Another approach involves measuring, cutting, and sewing the cloth by hand or with a sewing machine. Sometimes the cloth is cut according to a sewing pattern, and the garment is further adjusted by a tailor to fit the wearer's measurements.

People make different clothes for different purposes. One such example includes sportswear and/or activewear that is specific for sporting or outdoor activity purposes. Exemplary sportswear garments include, for example, tracksuits, shorts, t-shirts, polo shirts, swimsuits, wet suits for diving or surfing, ski suits, and leotards for gymnastics. Sportswear may be designed with a wearer's comfort and/or performance in mind. For example, gymnastics clothing may use easily deformable fabric for easy movement. For example, apparels for long distance running may be designed to keep the wearer in good comfort by offering good moisture wicking properties to enable sweat to transfer from the inside to the outside for the garment. Clothing for outdoor sports in the winter or snow sports may use breathable fabrics with insulative properties. Women's swimsuits include one-piece, bikinis, or thongs.

SUMMARY

Apparatus and associated methods relate to a garment having adjustable closure modules to reduce unwanted exposure. In an illustrative example, a continuous one-piece swimsuit may include at least one distributed tension closure system (DTCS) at each side of the swimsuit. The DTCS, for example, may include an elastic layer disposed underneath a longitudinally adjustable tension member coupled to opposing lateral edges of the DTCS. For example, when the swimsuit is donned by a wearer and lengths of the adjustable tension members are individually adjusted to a corresponding desired tension, each adjustable tension members may urge the opposing lateral edges together by the corresponding desired tension such that an aperture of the hip openings is adjusted to reduce unwanted exposure of a body of the wearer. Various embodiments may advantageously provide modest fittings while maintaining a substantially smooth layer fitting comfortably to the wearer.

The DTCS may be used to advantageously fit wearers with distributed tension to enhance comfortability and aesthetic value. In an illustrative example, the DTCS may be embedded or integrated in a swimsuit. The swimsuit may, for example, include a DTCS substantially extending from under a wearer's arm to a user's hip. The swimsuit, for example, may include two designated tension openings at each side of the garment, one near the hip and another underarm of the wearer. In some implementations, a wearer may adjust the openings by applying tension at the closure cord and hold the width of the opening using the stopper during use. The wearer may cover the DTCS with a covering layer by, for example, zipping the covering layer. Various embodiments may advantageously improve the wearer's comfort by preventing abrasion and pinching.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1A:
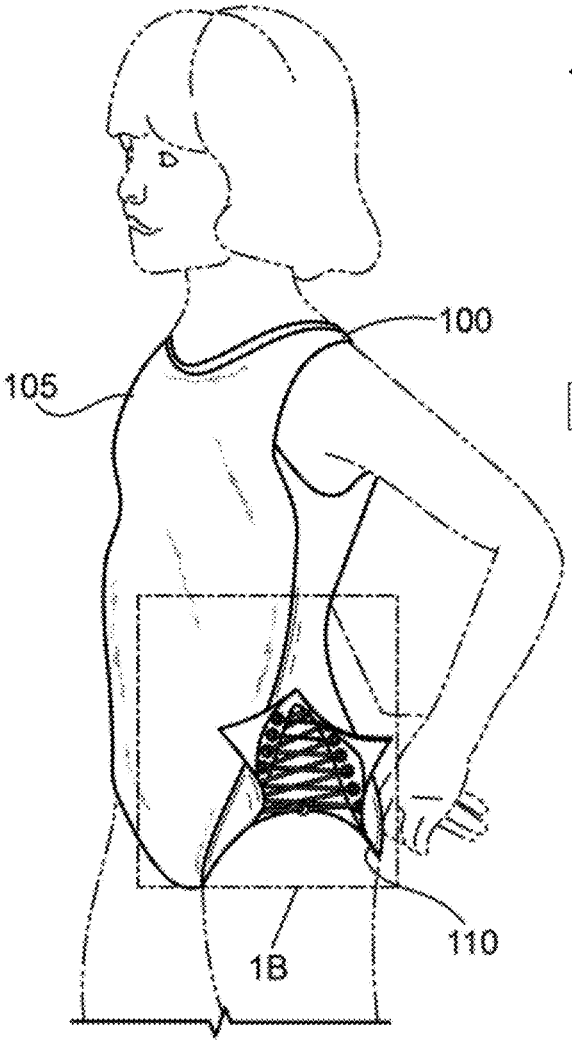
FIG. 1A, FIG. 1B, FIG. 1C, and FIG. 1D depict exemplary distributed tension closure garments (DTCGs) in an illustrative use-case scenario.
Figure 1B:
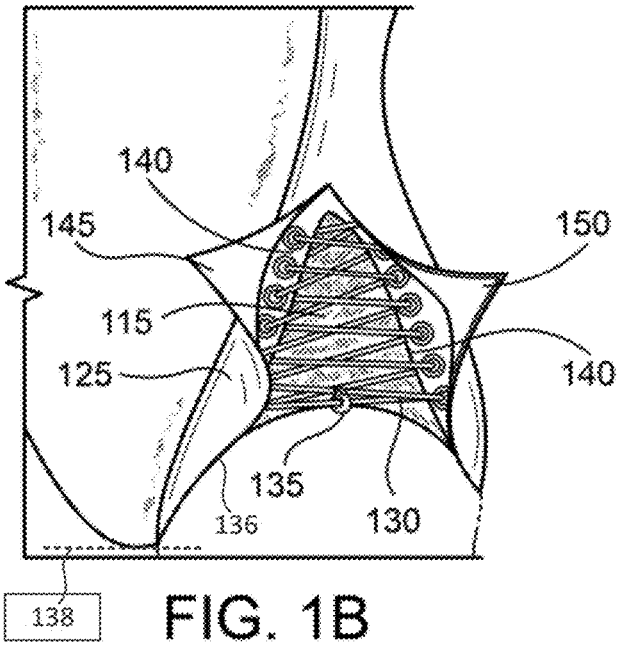
Figure 1C:
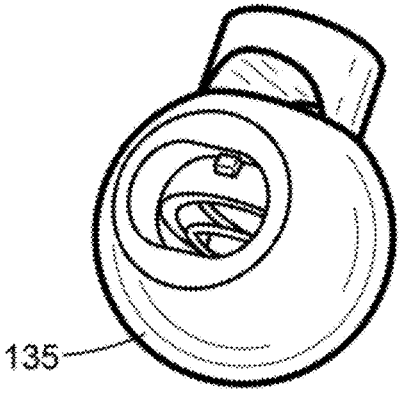

FIG. 1A and FIG. 1B depict exemplary distributed tension closure garments (DTCGs 100) in an illustrative use-case scenario. As shown in FIGS. 1A-1C, the DTCG 100 is made with, among other accessories and/or fabric, a shell fabric 105 and two distributed tension closure systems (DTCS) 110, one at each side of the DTCG 100. In the depicted example, the DTCS 110 is located around the hip area of the DTCG 100. For example, the DTCS 110 may extend from a leg opening of the DTCG 100 longitudinally towards an underarm portion of the DTCG 100. The DTCS 110 includes a lining panel 115, a tension distribution layer 120, and a covering layer 125.

The DTCG 100 is, in this example, a swimsuit. In various embodiments, the DTCG 100 may be worn by children for swimming. In this example, the DTCG 100 is made mostly with the shell fabric 105. For example, the shell fabric may include elastic materials. Exemplary elastic materials that may include the shell fabric include, by way of example and not limitation, Nylon (polyamides), elastane, polyester, or some combination thereof. In some implementations, the shell fabric 105 may include materials used for swimsuits. In this example, the shell fabric 105 is combined with the DTCS 110. In some embodiments, a user (e.g., child) who wears the DTCG 100 may advantageously benefit from the combination of the shell fabric 105 and the DTCS 110 comfortably and adjustably fitting the body of the child at one or both of the two designed openings, underarm and around the hip.

In the DTCS 110, the lining panel 115 may be made, for example, with material with highly elastic properties. In some implementations, the lining panel 115 may stay substantially flat without wadding in both open state and fitted state of the closure due to the elasticity of the panel 115. In some implementations, the lining panel may be constructed of a 4-way stretchable fabric. In some examples, compositions of the lining panel 115 may include elastane, spandex, or other elastic fibers. In some examples, the lining panel 115 may also be durable and chlorine resistant. Because of the flat surface and, thus, in some examples, substantially evenly distributed pressure on a wearer's skin, the lining panel 115 may advantageously improve the wearer's comfort by preventing abrasion and pinching.

The tension distribution layer 120 includes a closure cord 130 and a stopper 135. For example, the closure cord 130 may be a zig-zagged drawstring. In other examples, the closure cord 130 may be an elastic tape. In other examples, the closure cord 130 may be a chain that is made with plastic, metal, and/or a natural material. The closure cord 130 joins two opposing edges 140. The two opposing edges 140, for example, may be part of the shell fabric 105. In other examples, the opposing edges 140 may be formed by other material independent of the shell fabric 105.

In various embodiments, the closure cord 130 may be arranged to join the two opposing edges 140 in a way that the tension between the opposing edges 140 are substantially evenly distributed. As an illustrative example, the closure cord 130 may be pulled to urge the opposing edges 140 closer together, thereby fitting the designated area to the size of the wearer. In this example, the designated areas for fitting are around the hip (e.g., a leg opening) and under the arm (armhole) of the area, where the two DTCS 110 are substantially located. For example, the closure cord 130 may be adjustable to the wearer's specific physiological structure by having a distributed tension along the body contour. Accordingly, the shell fabric 105 may, for example, be advantageously fitted to a user's specific body structure.

As depicted, for example, a tension (T) may be applied to the closure cord 130. The tension may be (substantially) evenly distributed along the entire cord. Accordingly, the closure cord 130 may apply a force (F) to each point of engagement (e.g., via a grommet and/or eyelet) with the tension distribution layer 120. Such embodiments may, for example, enable a user to apply a substantially evenly distributed force that may be advantageously applied quickly and/or easily. The evenly distributed force may, for example, advantageously enhance user comfort. The evenly distributed force may, for example, advantageously eliminate tight spots and/or loose spots due to garment contour misalignment with body contour.

As an illustrative example without limitation, the lining panel 115 may be coupled with the tension distribution layer 120 and/or the shell fabric 105 by thread sewing (e.g., overlock seam, double stitching), taping, bonding, or some combination thereof. When a wearer fits the DTCG 100 by tightening the closure cord 130, in some implementations, the tension between the closure cord 130 and the body of the wearer may be substantially evenly distributed along the body contour of the wearer due to the highly elastic nature of the lining panel 115. For example, the tension may be distributed evenly via the surface of the lining panel 115. In some embodiments the lining panel 115 may, for example, assist the shell fabric 105 in distributing the tension. In some embodiments the closure may be coupled to the lining panel 115 directly. In various embodiments, the distributed tension may advantageously prevent uncomfortable tight spots and/or immodest or unsightly loose spots.

The stopper 135 is, in the depicted example, coupled with the closure cord 130. For example, the wearer may use the stopper 135 to control the tension applied to the closure cord 130 and therefore hold the width of the opening between the opposing edges 140.

In some implementations, the DTCG 100 may be a continuous garment. For example, the DTCG 100 may be produced as a seamless garment. The DTCG 100, for example, may be produced by combining a few fabric panels (sewn, bonded) together to form a continuous garment. In various implementations, the opposing edges 140 may be joined at a middle portion between a hem at the DTCS 110 and the underarm portion of the DTCG 100. In some examples, the middle portion may provide reference for smoothing crinkling of fabric at the hem after tension adjustment.

As shown, the DTCS 110 is triangular shaped. For example, the triangulated DTCS 110 may include a downward tension force at the DTCS 110. For example, the downward force may reduce crinkle effect at the DTCG 100 and improve comfortability of the wearer.

In some implementations, the DTCG 100 may advantageously decrease gapping between two sizes (e.g., a 25 to a 26). For example, a child wearing the DTCG 100 may use the DTCS 110 to adjust or remove a gap at a leg opening 136 without tightening the DTCG 100 at other parts of the DTCG 100. As an illustrative example, the DTCS 110 may provide an adjustable range of substantially about 0.5-1 inch of gap at the leg opening 136. In this example, the DTCG 100 includes a crotch line 138. For example, as depicted, the crotch line 138 may define a lowermost terminal edge of the DTCG 100. For example, as shown, the crotch line 138 may be lower than a highest point of the leg opening 136.

Layering on top of the opposing edges 140, the covering layer 125 includes a first edge 145 and a second edge 150. In this example, the first edge 145 and the second edge 150 can be releasably coupled together by a fastener. For example, the fastener may be a zipper, a set of Velcro tape, one or more snap buttons, a magnetic fasteners pair, one or more hook buttons, or other fastening mechanisms. In a fastened state, the covering layer 125 covers the tension distribution layer 120 and the lining panel 115 in the depicted example. When the covering layer 125 is unfasten, in this example, the tension distribution layer 120 is revealed and the closure cord 130 is available for adjustment.

In some implementations, the covering layer 125 may, in the fastened state, advantageously protect the tension distribution layer 120 from being inadvertently or unintentionally operated during use. For example, the covering layer 125 may protect the tension distribution layer 120 from external objects snagging on the closure cord 130 during use. In some implementations, the covering layer 125 may conceal the tension distribution layer 120 and the lining panel 115 to provide aesthetic value to the DTCG 100. For example, the covering layer 125 may be solid colored or printed with patterns or other artwork (e.g., by digital printer) to offer aesthetic value.

In various embodiments, the DTCS 110 that includes the covering layer 125, the tension distribution layer 120 with the closure cord 130 and the stopper 135, and the lining panel 115 may be used to advantageously fit wearers with distributed tension to enhance comfortability and aesthetic value.

Figure 1D:
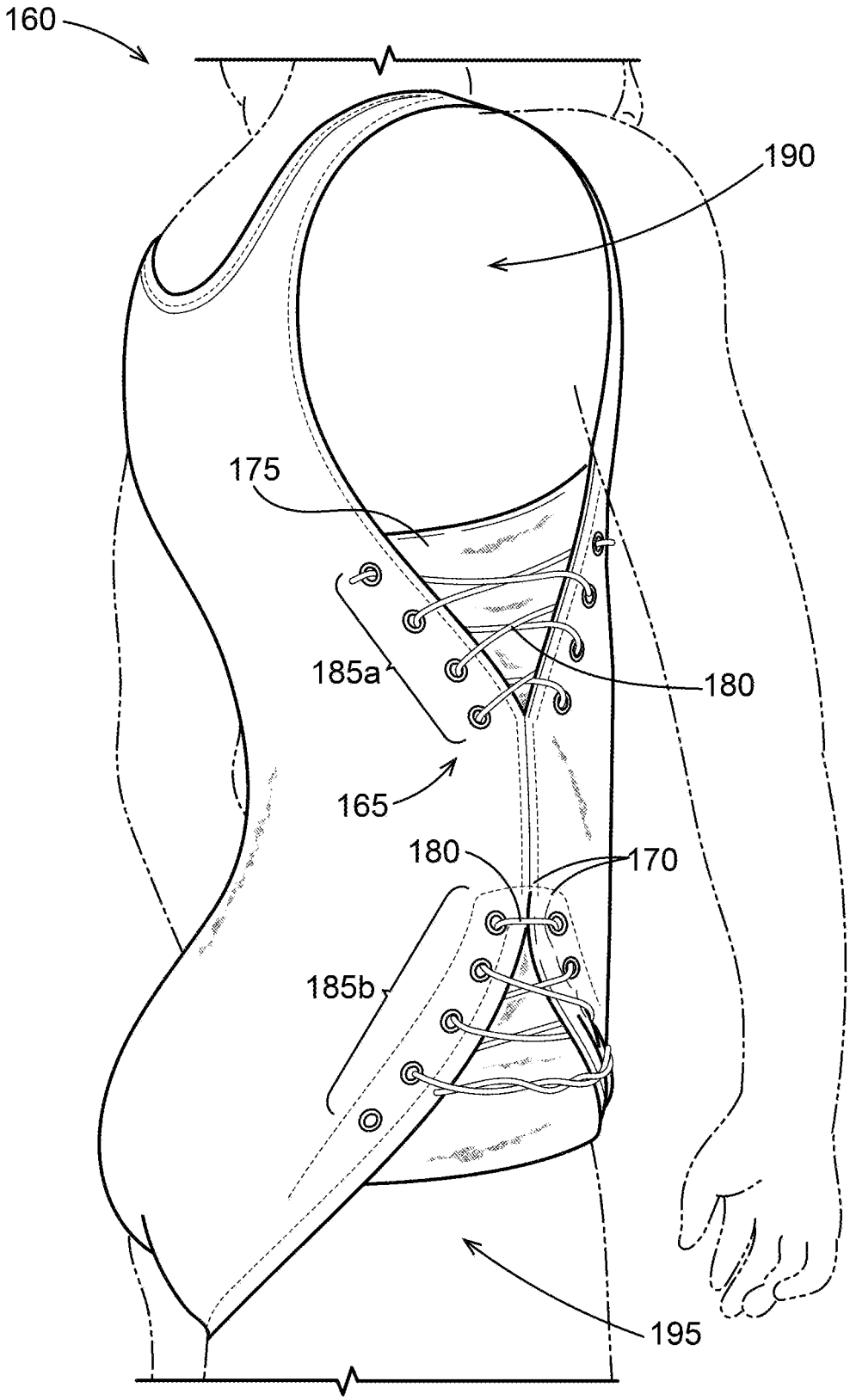

As shown in FIG. 1D, a continuous swimsuit 160 includes an upper DTCS 165 and a lower DTCS 170. For example, the continuous swimsuit 160 may include the upper DTCS 165 and the lower DTCS 170 at each side of the continuous swimsuit 160. The upper DTCS 165 extends longitudinally from an underarm opening towards a hip portion of the continuous swimsuit 160. The lower DTCS 170 extends longitudinally from a leg opening towards an underarm portion of the continuous swimsuit 160. In this example, the DTCS 165, 170 includes an elastic layer 175 disposed underneath a tension adjustment cord 180. For example, the elastic layer 175 may separate the tension adjustment cord 180 to a body of a wearer. As shown the tension adjustment cords 180 are coupled to engagement points 185*a*, 185*b*.

In operation, the continuous swimsuit 160 may be fitted by tightening the tension adjustment cords 180. For example, the tension adjustment cords 180 may be longitudinally adjustable. For example, the tension adjustable cords 180 may be adjusted in length so that an arm aperture 190 and a leg aperture 195 may be individually adjusted. In this example, after a desired tension is obtained, the tension adjustment cords 180 may be tied into a knot to fix the desired tension at the engagement points 185*a* and 185*b*.

In various implementations, the tension adjustment cords 180 may urge opposing lateral edges together by the corresponding desired tension. In some examples, the apertures 190, 195 may advantageously be adjusted to reduce exposure of a body of a wearer. The elastic layer 175 may, for example, be advantageously stretchable so that bunching or crinkling of the elastic layer 175 is substantially mitigated to improve comfort of the wearer.

Figure 2:
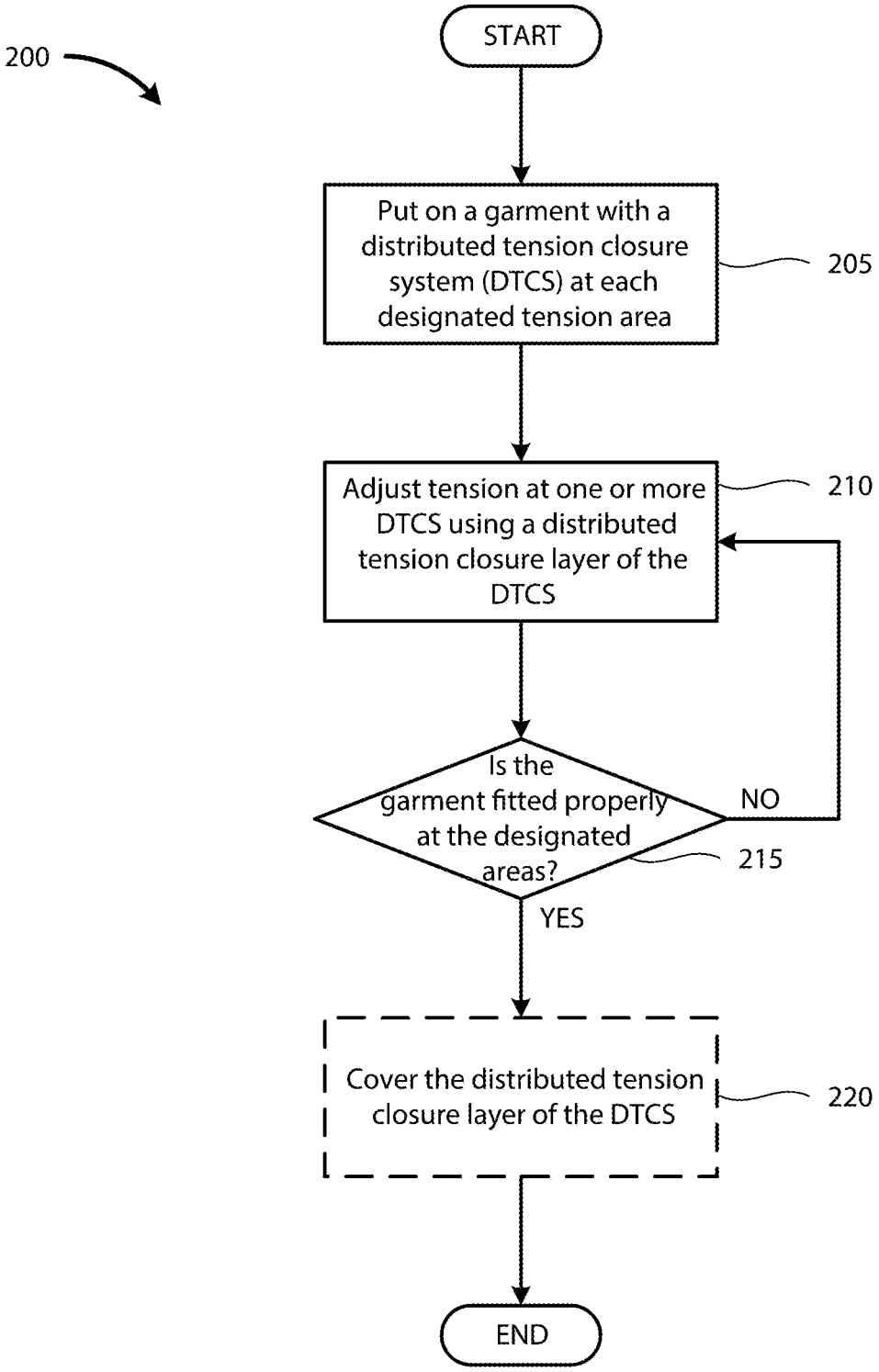
FIG. 2 is a flowchart to illustrate an exemplary method for fitting a piece of garment using a distributed tension closure system (DTCS).

FIG. 2 is a flowchart to illustrate an exemplary method 200 for fitting a piece of garment using a distributed tension closure system. In one example, the piece of garment may be a swimsuit. For example, the distributed tension closure system may be the DTCS 110 as described in FIG. 1A.

The method 200 starts when a user or a wearer puts on the garment with a distributed tension closure system at each designated tension area in step 205. For example, the garment may have designated tension areas at the hip and under arm on both left and right side of the garment.

Next, tension is adjusted at one or more DTCS using a distributed tension closure layer of the DTCS in step 210. For example, the user may adjust the closure cord 130 to tighten or loosen the tension as described in FIG. 1. As a result, for example, the dimension of the designated areas may be adjusted to fit the user.

In step 215, it is determined whether the garment is fitted properly at the designated areas. For example, it may be determined that the garment is fitted properly based on substantially absence of uncomfortable tight spots and/or immodest or unsightly loose spots at hip opening or underarm of a wearer.

If it is determined that the garment is not fitted properly at one or more designated areas, then the step 210 is executed. If it is determined that the garment is fitted properly at one or more designated areas, then, in an optional step 220, the distributed tension closure layer of the DTCS is covered and the method 200 ends. For example, a covering layer with two edges may be fastened to cover the distributed closure layer for concealing the closure layer.

Figure 3:
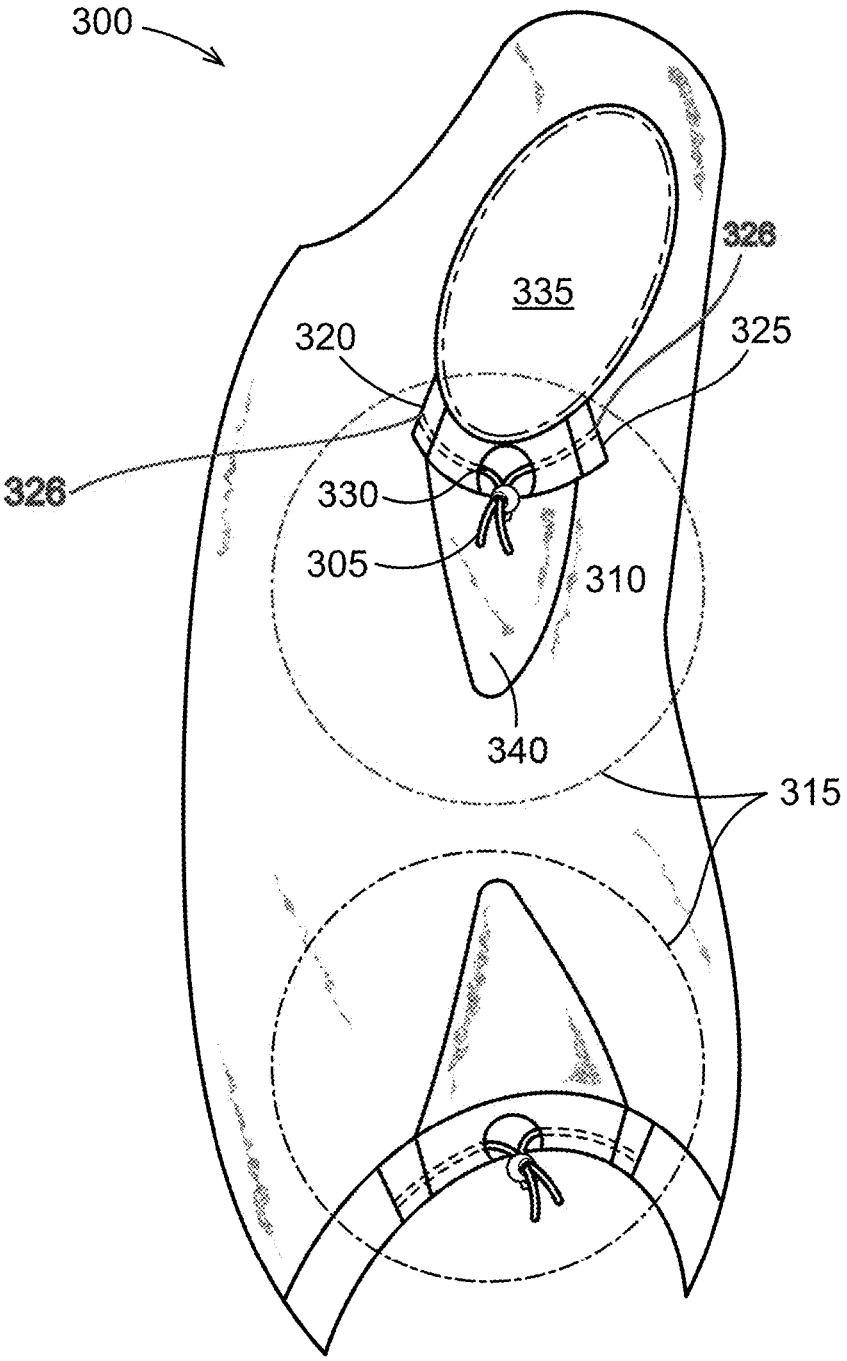
FIG. 3 depicts an exemplary DTCG with a drawstring and a stopper adjuster.

Other embodiments of the DTCS may be constructed to fit various garment designs. In some implementations, the DTCS may be a continuous closure area on each side, from underarm to hip. FIG. 3 depicts an exemplary DTCG 300 with a drawstring and a stopper adjuster. In this example, an elastic drawstring 305 is disposed within a tunnel 310 of a DTCS 315. As shown, the elastic drawstring 305 may be coupled 326 to lateral opposing edges 320, 325. For example, the elastic drawstring 305 may be coupled 326 to the lateral opposing edges 320, 325 by bonding. The elastic drawstring 305 may be coupled 326 to the lateral opposing edges 320, 325 by, for example, reinforcement stitching (e.g., bartack stitching, double stitching). Each of the elastic drawstrings 305 is coupled to a stopper 330. To adjust an aperture 335, a wearer may, for example, adjust a relative position of the stopper 330 at the elastic drawstring 305. For example, the elastic drawstring 305 may urge the lateral opposing edges 320, 325 closer when more of the elastic drawstring 305 is pulled out from the tunnel 310. In this example, the DTCS 315 includes an elastic layer 340 to distribute tension evenly between the lateral opposing edges 320, 325.

In various embodiments a DTCS may, for example, be provided in gymnastic clothing (e.g., a gymnasium suit). In various embodiments a DTCS may, for example, be provided in underclothing. In various embodiments a DTCS may, for example, be provided in outer garments. In various embodiments a DTCS may, for example, be provided in active wear and/or protective wear (e.g., ski suit, jumpsuit, overalls, coveralls).

In various embodiments a DTCS may, for example, be disposed on a front of a garment. A DTCS may, by way of example and not limitation, be disposed on a rear of a garment.

Although various embodiments have been described with reference to the figures, other embodiments are possible. In some implementations, a DTCS may be manufactured as a modulated accessory or fastening part. For example, the DTCS may include a fastening mechanism or otherwise be easily integrated with the rest of the garment. For example, the DTCS may include flaps or other mechanisms for combination (e.g., for sewn on and/or taped together) with shell fabric of the garment. In some embodiments, this may advantageously reduce cost for designing, developing, and/or producing a garment using the DTCS.

Although an exemplary system has been described with reference to the figures, other implementations may be deployed in other industrial, scientific, medical, commercial, and/or residential applications. For example, the DTCS may be applicable to garments that need to be fitted to avoid immodest sightings (e.g., gymnastics, wet suit/dry suit for surfing and diving, dance/ballet uniforms).

In an illustrative aspect, a garment may include a continuous garment body (e.g., 100) and, two pairs of adjustable closure modules (e.g., 110), each pair at a side of the garment body. For example, each adjustable closure modules may include a hip module (e.g., 170) extending longitudinally from a hem of one side of a leg opening towards an armhole of the one side, and an underarm module (e.g., 165) extending longitudinally from under the armhole of one side of an arm opening towards the one side of a hip portion of the garment body. For example, each of the adjustable closure modules may include an elastic layer (e.g., 115) disposed underneath a tension adjustable layer. The tension adjustable layer may, for example, include a longitudinally adjustable tension member (e.g., 130) coupled to opposing lateral edges (e.g., 140) of the adjustable closure modules. For example, when the garment is donned by a wearer and a length of the adjustable tension members of each of the adjustable closure modules are individually adjusted to a corresponding desired tension, each adjustable tension members, for example, may urge the opposing lateral edges together by the corresponding desired tension such that an aperture (e.g., 190) of the corresponding openings the garment body may be fitted to reduce exposure of a body of the wearer. For example, the elastic layer may maintain a substantially smooth layer separating the body from the corresponding adjustable tension member.

The continuous garment body may be a one-piece swimsuit. The continuous garment body may be a gymnasium suit. The elastic layer may, for example, include a 4-way stretchable fabric. The elastic layer may include polyamides. The tension member, for example, may include a closure cord and a stopper. For example, the closure cord is coupled to the lateral edges by inserting through a plurality of points of engagement at each side of the lateral edges. For example, upon a corresponding desired tension being fixed with the stopper, the tension exerted at each of the plurality of points of engagement may be substantially evenly distributed such that abrasion and pinching are substantially mitigated. For example, the tension member may include an elastic drawstring and a stopper. The elastic drawstring may be coupled to the lateral edges by a reinforcement stitch. For example, an opening of the aperture of a corresponding leg opening of the continuous garment body may be reduced between 0 inch and 1.5 inch in circumference after the length of the adjustable tension members is adjusted.

In an illustrative aspect, a garment may include a continuous garment body (e.g., 100), and two adjustable closure modules (e.g., 110). For example, each of the adjustable closure modules may be disposed at a side of the garment body and extending longitudinally from an opening towards a middle portion of the garment body of the one side. For example, each of the adjustable closure modules may include an elastic layer (e.g., 115) and means for adjusting an aperture (e.g., 190) of the opening (e.g., 130). For example, the aperture adjusting means may be coupled to opposing lateral edges (e.g., 140) of the adjustable closure module. For example, when the garment is donned by a wearer and the aperture adjusting means are individually operated, each of the aperture adjusting means may urge opposing lateral edges together. For example, an aperture of a corresponding opening of the garment body may be fitted to reduce exposure of a body of the wearer. For example, the elastic layer may maintain a substantially smooth layer separating the body from the corresponding aperture adjusting means.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A garment comprising:

a continuous garment body; and, two pairs of adjustable closure modules, each pair at a respective side of the continuous garment body and comprising:

a hip module extending longitudinally from a hem of one side of a leg opening towards an armhole of the respective side of the continuous garment body; and, an underarm module extending longitudinally from under the armhole of the respective side of the continuous garment body towards a hip portion of the continuous garment body, wherein:

each of the adjustable closure modules comprises an elastic layer disposed underneath a tension adjustable layer, and the tension adjustable layer comprises a longitudinally adjustable tension member coupled to opposing lateral edges of the adjustable closure module such that, when the garment is donned by a wearer and a length of the longitudinally adjustable tension members of each of the adjustable closure modules are individually adjusted to a corresponding desired tension, then each longitudinally adjustable tension members urges the corresponding opposing lateral edges together by the corresponding desired tension such that an aperture of the corresponding leg opening, or armhole of the continuous garment body is fitted to reduce exposure of a body of the wearer, the elastic layer maintains a substantially smooth layer separating the body of the wearer from a corresponding one of the longitudinally adjustable tension members, and the garment is configured such that, a crotch line defines a lowermost terminal edge of the garment such that the crotch line is lower than a highest point of the garment leg openings.

2. The garment of claim 1, wherein the continuous garment body is a one-piece swimsuit.

3. The garment of claim 1, wherein the continuous garment body is a gymnasium suit.

4. The garment of claim 1, wherein the elastic layer comprises a 4-way stretchable fabric.

5. The garment of claim 1, wherein the elastic layer comprises polyamides.

6. The garment of claim 1, wherein the longitudinally adjustable tension member comprises a closure cord and a stopper, wherein the closure cord is coupled to the opposing lateral edges by inserting through a plurality of points of engagement at each side of the opposing lateral edges.

7. The garment of claim 6, wherein, upon the corresponding desired tension being fixed with the stopper, a tension exerted at each of the plurality of points of engagement is substantially evenly distributed such that abrasion and pinching are substantially mitigated.

8. The garment of claim 1, wherein the longitudinally adjustable tension member comprises an elastic drawstring and a stopper, wherein the elastic drawstring is coupled to the opposing lateral edges by a reinforcement stitch.

9. The garment of claim 1, wherein measurement of the aperture of a corresponding leg opening of the continuous garment body is capable of being reduced between 0 inch and 1.5 inches in circumference after the length of the longitudinally adjustable tension member is adjusted.

10. The garment of claim 1, wherein the continuous garment body comprises a shell fabric made of elastic materials.

11. The garment of claim 1, wherein each of the elastic layers disposed underneath a respective one of the tension adjustable layers comprises a separate fabric panel, such that the garment comprises four distinct elastic panels.

12. The garment of claim 11, wherein the separate fabric panel comprises a tapered panel, wherein, in the underarm module, the tapered panel comprises a width that tapers toward the leg opening along the respective side, and, in the hip module, the tapered panel comprises a width that tapers toward the armhole along the respective side.

13. A garment comprising:

a continuous garment body; and, two adjustable closure modules, each of the adjustable closure modules being disposed at a respective side of the continuous garment body and extending longitudinally from a hem of the continuous garment body from a leg opening of the respective side towards an armhole of the respective side of the continuous garment body, and each of the adjustable closure modules comprising an elastic layer disposed underneath a tension adjustable layer, wherein:

the tension adjustable layer comprises a longitudinally adjustable tension member coupled to opposing lateral edges of the adjustable closure module such that, when the garment is donned by a wearer and a length of the longitudinally adjustable tension members of each of the adjustable closure modules are individually adjusted to a corresponding desired tension, then each one of the longitudinally adjustable tension members urges the corresponding opposing lateral edges together by the corresponding desired tension such that an aperture of a corresponding leg opening on the continuous garment body is fitted to reduce exposure of a body of the wearer, the elastic layer maintains a substantially smooth layer separating the body of the wearer from a corresponding one of the longitudinally adjustable tension members, and the garment is configured such that, a crotch line defines a lowermost terminal edge of the garment such that the crotch line is a lower than a highest point of the leg openings.

14. The garment of claim 13, further comprising two additional adjustable closure modules, each additional adjustable closure module being disposed under a respective armhole of a corresponding respective side of the continuous garment body and extending longitudinally towards a corresponding leg opening such that an aperture of each respective armhole is independently adjustable to avoid exposure of an upper body of the wearer.

15. The garment of claim 13, wherein the continuous garment body is a one-piece swimsuit.

16. The garment of claim 13, wherein the continuous garment body is a gymnasium suit.

17. The garment of claim 13, wherein the elastic layer comprises a 4-way stretchable fabric.

18. The garment of claim 13, wherein the elastic layer comprises polyamides.

19. The garment of claim 13, wherein the longitudinally adjustable tension member comprises a closure cord and a stopper, wherein the closure cord is coupled to the opposing lateral edges by inserting through a plurality of points of engagement at each side of the opposing lateral edges.

20. The garment of claim 19, wherein, upon the corresponding desired tension being fixed with the stopper, the tension exerted at each of the plurality of points of engagement is substantially evenly distributed such that abrasion and pinching are substantially mitigated.

21. The garment of claim 13, wherein the longitudinally adjustable tension member comprises an elastic drawstring and a stopper, wherein the elastic drawstring is coupled to the opposing lateral edges by a reinforcement stitch.

22. The garment of claim 13, wherein a measurement of the aperture of a corresponding leg opening of the continuous garment body is capable of being reduced by up to 1.5 inches in circumference after the length of the longitudinally adjustable tension member is adjusted.

23. The garment of claim 13, wherein the continuous garment body comprises a shell fabric made of elastic materials.

24. The garment of claim 23, wherein each elastic layer disposed underneath a respective tension adjustable layer comprises a separate fabric panel.

25. The garment of claim 23, wherein the separate fabric panel comprises a tapered panel, wherein the tapered panel comprises a width that tapers towards the armhole along the respective side.

26. The garment of claim 23, wherein the elastic materials comprise elastane.

* * * * *